United States Patent [19]

Lipschutz

[11] 4,229,278

[45] Oct. 21, 1980

[54] ELECTROLYTIC SUPPORT ASSEMBLY

[75] Inventor: Paul Lipschutz, Croissy, France

[73] Assignee: Neiman S.A., Courbevoie, France

[21] Appl. No.: 15,388

[22] Filed: Feb. 26, 1979

[30] Foreign Application Priority Data

Mar. 10, 1978 [FR] France ..... 78 06914

[51] Int. Cl.[2] ..... C25D 17/06

[52] U.S. Cl. ..... 204/297 R

[58] Field of Search ..... 204/297 R, 297 W

[56] References Cited

U.S. PATENT DOCUMENTS

| | | | |
|---|---|---|---|
| 3,970,540 | 7/1976 | McBain | 204/297 R |
| 4,025,414 | 5/1977 | Vendramini | 204/297 R |

*Primary Examiner*—Howard S. Williams

*Attorney, Agent, or Firm*—James Creighton Wray

[57] ABSTRACT

In numerous treatment processes it is necessary to ensure a secure and effective clamping of a movable part against a fixed part.

A clamping device for an electrolytic plating bath comprises a circular plate having a plurality of apertures for receiving articles to be plated. The articles are held in position by a clamping device comprising a thermostatic element having a movable clamp subject to a translational movement under the effect of an increase in temperature, the said movable assembly cooperating with the piece to be clamped.

By means of the device according to the invention an effective and positive clamping is obtained in a range of desired temperatures which is precisely defined by virtue of the choice of an appropriate thermostatic element.

8 Claims, 2 Drawing Figures

ELECTROLYTIC SUPPORT ASSEMBLY

BACKGROUND TO THE INVENTION

The invention relates to a novel clamping device applicable especially, but not exclusively, to an electrolytic treatment assembly.

In numerous treatment processes it is necessary to ensure a secure and effective clamping of a movable part against a fixed part. This is the case in particular in processes for electrolytic treatment of metallic pieces through which an electric current must pass.

Numerous clamping devices have been proposed which use mechanical, magnetic, electromagnetic energy etc. In numerous cases these known devices necessitate an external energy supply (electric cables, pneumatic pipes, etc.) and do not ensure an efficacious and adequate clamping, especially when the object is to establish an electric contact in an assembly immersed in an electrolytic bath.

OBJECT OF THE INVENTION

The present invention aims at obtaining such clamping in a positive, effective, repeatable and certain manner.

SUMMARY OF THE INVENTION

To this end the invention has for object a device for clamping a piece, characterised in that it is constituted by a thermostatic element comprising a movable assembly subjected to a translational movement under the effect of an increase in temperature, the said movable assembly co-operating with the piece to be clamped.

By means of the device according to the invention an effective and positive clamping is obtained in a range of desired temperatures which is precisely defined by virtue of the choice of an appropriate thermostatic element.

BRIEF DESCRIPTION OF DRAWINGS

The invention will be clearly understood on reading of the following description given with reference to the accompanying drawing, wherein.

DESCRIPTION OF PREFERRED EMBODIMENT

Figure 1:
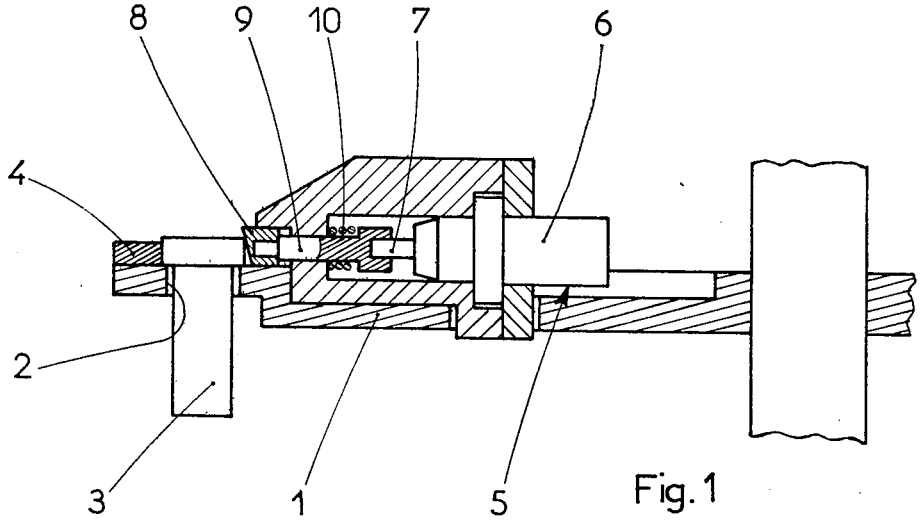
FIG. 1 is a diagrammatic axial sectional view of an electrolytic treatment apparatus comprising a clamping device according to the invention.
Figure 2:
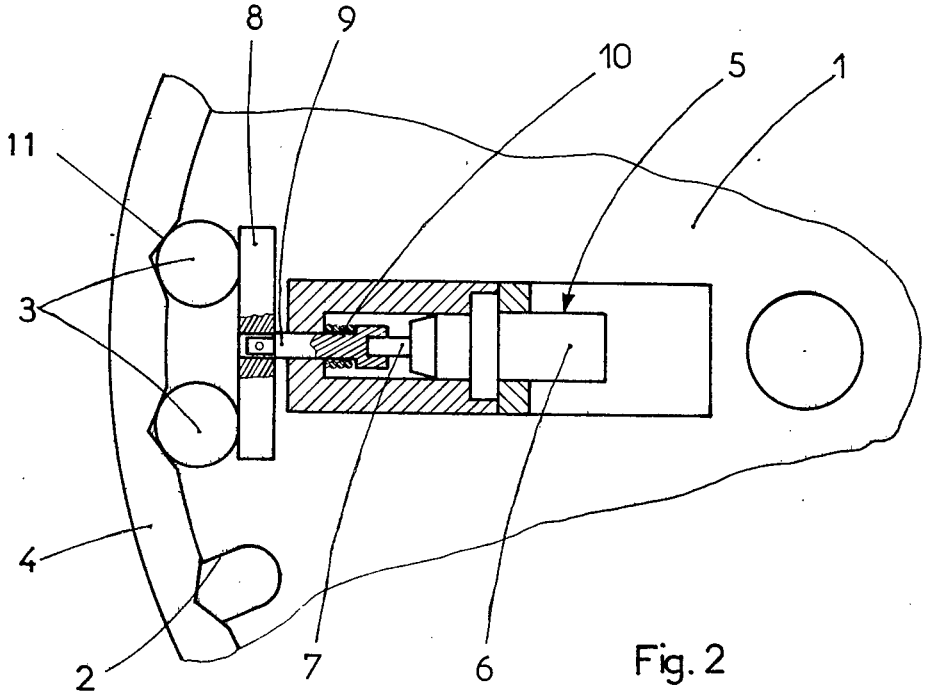
FIG. 2 is a plan view of a part of the apparatus according to FIG. 1.

The invention is illustrated by way of non-limitative example by the use of this clamping device in an electrolytic treatment apparatus.

The apparatus comprises a plate 1 which, in the example of embodiment as represented, is circular and comprises sockets 2 in which metallic pieces 3 are mounted which are to be subjected to the electrolytic treatment, the whole being immersed successively in one or more treatment baths, the temperature of which is higher than the ambient temperature. The plate 1 comprises a conductive annular rim 4 connected to a current source. The pieces 3 are in contact with the rim 4.

The plate 1 carries a plurality of thermostatic elements 5 in each of which the body 6 is fast with the plate 1 and the movable rod 7 is directed radially towards the rim 4, the angular positioning of the elements 5 being such that one rod 7, and only one, is placed along the bisector of the angle at the centre joining two adjacent sockets 2.

A compensator bar 8 is mounted to slide radially between a thermostatic element 5 and the corresponding pieces 3, with a rod 9 prolonging a rod 7 of the thermostatic element 5. A helical spring 10 tends to remove the compensator bar 8 from the pieces 3, the dimensions of the compensator bar 8 being such that it covers the two pieces 3 which are opposite to it.

In the course of the treatment procedure, as soon as the temperature reaches the set response temperature of the thermostatic elements 5, their rods 7 experience a radial translational movement towards the rim 4 and push back the compensator bars 8, against the action of the springs 10, in order to bring them to press against the pieces 3, closing the electric circuit between the piece to be treated and a contact point 11. As soon as the temperature drops again below the set response temperature, the rods 7 are retracted and the compensator bars 8, under the action of the springs 10, depart from the pieces 3, interrupting the electrical and mechanical connection.

The plates 1 can be removable and their charging can easily be effected outside the treatment vessel, by automatic means. Discharging is likewise facilitated. In coming out of the treatment vessel the plate 1 in effect returns to the ambient temperature and the pieces 3 are no longer clamped and can be removed by simple inversion of the plate 1. The plate 1 can be rotatable, for example to permit mechanical drying in order to eliminate the treatment liquid.

I claim:

1. A support assembly for clamping at least one workpiece to be subjected to treatment during which the temperature of the workpiece is raised above a predetermined level comprising:

(a) a carrier plate, (b) first clamping means on said carrier plate, (c) second clamping means on said carrier plate movable towards said first clamping means to effect securing of said workpiece between said first and second clamping means during treatment, and (d) driving means secured to said carrier plate capable of effecting a translational movement of said second clamping means, said driving means including (e) a body, (f) a temperature sensitive expansion means within said body, and (g) a driving rod extending from said body and movable by said expansion means, which rod is caused to extend further from the body by said sensitive means to effect clamping of the workpiece by the clamping means as the temperature of the sensitive means is increased beyond said predetermined level and is caused to move back into the body when the temperature falls below said level to release the workpiece.

2. A support assembly according to claim 1, wherein said plate is circular and a plurality of said driving means are disposed respectively radially thereon.

3. A support assembly according to claim 2, for use in an electrolytic plating process, wherein said first clamping means is in the form of an electrically conductive rim.

4. A support assembly according to claim 3, wherein said second clamping means comprises a clamping bar which acts on two adjacent workpieces simultaneously.

5. A support assembly according to claim 4, wherein said rim is provided with a series of notches, each notch serving to locate a respective workpiece.

6. A support assembly according to claim 5, wherein said plate is provided with a series of apertures therein adjacent said notches to receive said workpieces.

7. A support assembly according to claim 2, wherein a shaft is provided which carries said plate for rotation thereby.

8. A support assembly according to claim 7, wherein said plate is removable for the purpose of discharging the workpieces.

* * * * *